US005540279A

United States Patent [19]

Branch et al.

[11] Patent Number: 5,540,279

[45] Date of Patent: Jul. 30, 1996

[54] DOWNHOLE TOOL APPARATUS WITH NON-METALLIC PACKER ELEMENT RETAINING SHOES

[75] Inventors: Alton L. Branch, Comanche; Donald R. Smith, Wilson; Kevin T. Berscheidt, Duncan, all of Okla.

[73] Assignee: Halliburton Company, Duncan, Okla.

[21] Appl. No.: 442,448

[22] Filed: May 16, 1995

[51] Int. Cl.[6] ..... E21B 23/00; E21B 33/128; E21B 33/129

[52] U.S. Cl. ..... 166/118; 166/134

[58] Field of Search ..... 166/134, 118, 166/123, 382, 195, 196, 187, 387

[56] References Cited

U.S. PATENT DOCUMENTS

| | | | |
|---|---|---|---|
| 1,648,377 | 11/1927 | Crowell | 166/131 X |
| 2,043,225 | 6/1936 | Armentrout et al. | 166/203 X |
| 2,084,611 | 6/1937 | Crickmer | 166/131 |
| 2,155,129 | 4/1939 | Hall et al. . | |
| 2,205,119 | 6/1940 | Hall et al. . | |
| 2,331,185 | 10/1943 | Gordy | 166/131 X |
| 2,589,506 | 3/1952 | Morrisett . | |
| 2,695,672 | 11/1954 | Lane . | |
| 2,753,940 | 7/1956 | Bonner . | |
| 2,778,430 | 1/1957 | Baker | 166/131 X |
| 2,806,536 | 9/1957 | Baker | 166/131 X |
| 3,055,424 | 9/1962 | Allen . | |
| 3,529,667 | 9/1970 | Malone . | |
| 3,643,282 | 2/1972 | Lechene et al. | 15/179 |
| 3,710,862 | 1/1973 | Young et al. | 166/278 |
| 3,910,348 | 10/1975 | Pitts | 166/134 |
| 4,067,358 | 1/1978 | Streich | 137/624.13 |
| 4,151,875 | 5/1979 | Sullaway | 166/126 |
| 4,300,631 | 11/1981 | Sainato | 166/187 |
| 4,520,870 | 6/1985 | Pringle | 166/317 |
| 4,708,202 | 11/1987 | Sukup et al. | 166/123 |
| 4,784,226 | 11/1988 | Wyatt | 166/376 |
| 4,834,176 | 5/1989 | Renfroe | 166/142 |
| 4,834,184 | 5/1989 | Streich et al. | 166/376 |
| 4,858,687 | 8/1989 | Watson et al. | 166/153 |
| 4,915,175 | 4/1990 | Mashaw | 166/134 X |
| 4,977,958 | 12/1990 | Miller | 166/205 |
| 5,224,540 | 7/1993 | Streich et al. | 166/134 X |
| 5,271,468 | 12/1993 | Streich et al. | 166/134 X |
| 5,390,737 | 2/1995 | Jacobi et al. | 166/134 X |

OTHER PUBLICATIONS

Fiberite Sales Brochure pp. 4–21.

Halliburton Services Sales and Service Catalog #43 selected pages.

Halliburton Services Sales Technical Paper entitled: Successful Drill Out of Shoe Joints With PDC Bits.

Fundamentals of Drilling by John L. Kennedy.

*Primary Examiner*—Stephen J. Novosad

*Attorney, Agent, or Firm*—Stephen R. Christian

[57] ABSTRACT

An improved downhole tool apparatus including, but not limited to, packers and bridge plugs which more fully utilize highly stressed non-metallic components, including slips, slip wedges, and packer element retaining shoes than prior tools. The non-metallic packer element retaining shoes of the present invention are preferably made of separate shoe segments initially held in place by at least one retaining band. Such non-metallic packer element shoes do away with troublesome prior art metallic shoes and backups which tended to spin upon each other or about the mandrel while milling or drilling the tool out of a wellbore. Therefore, the subject invention increases the ability to drill or mill downhole tools out of a well bore in less time than it would take with using conventional or non-conventional drilling or milling techniques or equipment.

19 Claims, 4 Drawing Sheets

DOWNHOLE TOOL APPARATUS WITH NON-METALLIC PACKER ELEMENT RETAINING SHOES

BACKGROUND OF THE INVENTION

1. Field of The Invention

This invention relates generally to downhole tools for use in well bores and methods of drilling such apparatus out of well bores, and more particularly, to such tools having drillable components made at least partially of non-metallic materials, such as engineering grade plastics, composites, and resins. This invention relates particularly to improvements in retaining packer elements commonly used in downhole drillable packer and bridge plug tools.

2. Description of The Prior Art

In the drilling or reworking of oil wells, a great variety of downhole tools are used. For example, but not by way of limitation, it is often desirable to seal tubing or other pipe in the casing of the well, such as when it is desired to pump cement or other slurry down the tubing and force the slurry out into a formation. It then becomes necessary to seal the tubing with respect to the well casing and to prevent the fluid pressure of the slurry from lifting the tubing out of the well. Downhole tools referred to as packers and bridge plugs are designed for these general purposes and are well known in the art of producing oil and gas.

When it is desired to remove many of these downhole tools from a well bore, it is frequently simpler and less expensive to mill or drill them out rather than to implement a complex retrieving operation. In milling, a milling cutter is used to grind the packer or plug, for example, or at least the outer components thereof, out of the well bore. Milling is a relatively slow process, but when milling with conventional tubular strings, it can be used on packers or bridge plugs having relatively hard components such as erosion-resistant hard steel. One such packer is disclosed in U.S. Pat. No. 4,151,875 to Sullaway, assigned to the assignee of the present invention and sold under the trademark EZ Disposal packer.

In drilling, a drill bit is used to cut and grind up the components of the downhole tool to remove it from the well bore. This is a much faster operation than milling, but requires the tool to be made out of materials which can be accommodated by the drill bit. Typically, soft and medium hardness cast iron are used on the pressure bearing components, along with some brass and aluminum items. Packers of this type include the Halliburton EZ Drill® and EZ Drill SV® squeeze packers.

The EZ Drill SV® squeeze packer, for example, includes a lock ring housing, upper slip wedge, lower slip wedge, and lower slip support made of soft cast iron. These components are mounted on a mandrel made of medium hardness cast iron. The EZ Drill® squeeze packer is similarly constructed. The Halliburton EZ Drill® bridge plug is also similar, except that it does not provide for fluid flow therethrough.

All of the above-mentioned packers are disclosed in Halliburton Services—Sales and Service Catalog No. 43, pages 2561–2562, and the bridge plug is disclosed in the same catalog on pages 2556–2557.

The EZ Drill® packer and bridge plug and the EZ Drill SV® packer are designed for fast removal from the well bore by either rotary or cable tool drilling methods. Many of the components in these drillable packing devices are locked together to prevent their spinning while being drilled, and the harder slips are grooved so that they will be broken up in small pieces. Typically, standard "tri-cone" rotary drill bits are used which are rotated at speeds of about 75 to about 120 rpm. A load of about 5,000 to about 7,000 pounds of weight is applied to the bit for initial drilling and increased as necessary to drill out the remainder of the packer or bridge plug, depending upon its size. Drill collars may be used as required for weight and bit stabilization.

Such drillable devices have worked well and provide improved operating performance at relatively high temperatures and pressures. The packers and bridge plugs mentioned above are designed to withstand pressures of about 10,000 psi (700 Kg/cm$^2$) and temperatures of about 425° F. (220° C.) after being set in the well bore. Such pressures and temperatures require using the cast iron components previously discussed.

However, drilling out iron components requires certain techniques. Ideally, the operator employs variations in rotary speed and bit weight to help break up the metal parts and reestablish bit penetration should bit penetration cease while drilling. A phenomenon known as "bit tracking" can occur, wherein the drill bit stays on one path and no longer cuts into the downhole tool. When this happens, it is necessary to pick up the bit above the drilling surface and rapidly recontact the bit with the packer or plug and apply weight while continuing rotation. This aids in breaking up the established bit pattern and helps to reestablish bit penetration. If this procedure is used, there are rarely problems. However, operators may not apply these techniques or even recognize when bit tracking has occurred. The result is that drilling times are greatly increased because the bit merely wears against the surface of the downhole tool rather than cutting into it to break it up.

In order to overcome the above long standing problems, the assignee of the present invention introduced to the industry a line of drillable packers and bridge plugs currently marketed by the assignee under the trademark FAS DRILL. The FAS DRILL line of tools consist of a majority of the components being made of non-metallic engineering grade plastics to greatly improve the drillability of such downhole tools. The FAS DRILL line of tools have been very successful and a number of U.S. patents have been issued to the assignee of the present invention, including U.S. Pat. No. 5,271,468 to Streich et al., U.S. Pat. No. 5,224,540 to Streich et al., and U.S. Pat. No. 5,390,737 to Jacobi et al. The preceding patents are specifically incorporated herein.

Notwithstanding the success of the FAS-DRILL line of drillable downhole packers and bridge plugs, the assignee of the present invention has discovered that certain metallic components still used within the FAS-DRILL line of packers and bridge plugs at the time of issuance of the above patents were preventing even quicker drill out times under certain conditions or when using certain equipment. Exemplary situations include milling with conventional jointed tubulars and in conditions in which normal bit weight or bit speed could not be obtained. Other exemplary situations include drilling or milling with non-conventional drilling techniques such as milling or drilling with relatively flexible coiled tubing.

When milling or drilling with coiled tubing, which does not provide a significant amount of weight on the tool being used, even components made of relatively soft steel, or other metals considered to be low strength, create problems and increase the amount of time required to mill out or drill out a down hole tool, including such tools as the assignee's FAS DRILL line of drillable non-metallic downhole tools.

Furthermore, packer shoes and optional back up rings made of a metallic material are employed not so much as a first choice but due to the metallic shoes and back up rings being able to withstand the temperatures and pressures typically encountered by a downhole tool deployed in a borehole.

Another shortcoming with using metallic packer shoes and optional backup rings is that upon deployment of the tool, the typically brass packer shoe may not flare outwardly as the packer portion is being compressed and therefore not expand outwardly as desired. If the brass shoe does not properly flare, it can lead to unwanted severe distortion of the shoes and subsequent cutting of the packer element which reduces its ability to hold to its rated differential pressure or lead to a complete failure of the tool.

These and other shortcomings are reduced, if not eliminated, by the present invention.

SUMMARY OF THE INVENTION

The improved downhole tool apparatus of the present invention preferably utilizes essentially all non-metallic materials, such as engineering grade plastics, resins, or composites, to reduce weight which facilitates and reduces shipping expenses, to reduce manufacturing time and labor, to improve performance through reducing frictional forces of sliding surfaces, to reduce costs and to improve drillability of the apparatus when drilling is required to remove the apparatus from the well bore. Primarily, in this disclosure, the downhole tool is characterized by a well bore packing apparatus, but it is not intended that the invention be limited to specific embodiments of such packing devices. The use of essentially only non-metallic components in the downhole tool apparatus allows for and increases the efficiency of alternative drilling and milling techniques in addition to conventional drilling and milling techniques.

In packing apparatus embodiments of the present invention, the apparatus may utilize the same general geometric configuration of previously known drillable non-metallic packers and bridge plugs such as those disclosed in U.S. Pat. No. 5,271,468 to Streich et al., U.S. Pat. No. 5,224,540 to Streich et al., and U.S. Pat. No. 5,390,737 to Jacobi et al. while replacing essentially all of the few remaining metal components of the tools disclosed in the preceding patents with non-metallic materials which can still withstand the pressures and temperatures found in many well bore applications. In other embodiments of the present invention, the apparatus may comprise specific design changes to accommodate the advantages of using essentially only plastic and composite materials and to allow for the reduced strengths thereof compared to metal components.

In a preferred embodiment of the downhole tool, the invention comprises a center mandrel and slip means disposed on the mandrel for grippingly engaging the well bore when in a set position. The apparatus further comprises a packing means disposed on the mandrel for sealingly engaging the well bore when in a set position.

The slip means comprises a slip wedge positioned around the center mandrel, a plurality of slip segments disposed in an initial position around the mandrel and adjacent to the slip wedge, retaining means for holding the slip segments in an initial position. In the preferred embodiment, the slip means utilizes separate slip segments. The retaining means is characterized by at least one retaining band extending at least partially around the slips. In another embodiment, the retaining means is characterized by a ring portion integrally formed with the slips. This ring portion is fracturable during a setting operation, whereby the slips are separated so that they can be moved into gripping engagement with the well bore. Hardened inserts may be molded into the slips. The inserts may be metallic, such as hardened steel, or non-metallic, such as a ceramic material.

In the preferred embodiment, the slip means includes a slip wedge installed on the mandrel and the slip segments, whether retained by a retaining band or whether retained by an integral ring portion, have coacting planar, or flat portions, which provide a superior sliding bearing surface especially when the slip means are made of a non-metallic material such as engineering grade plastics, resins, phenolics, or composites.

Also in the preferred embodiment of applicant's present invention, prior art packer element shoes and back up ring, such as those referred to as elements 37 and 38, 44 and 45, in the assignee's U.S. Pat. No. 5,271,468, are replaced by a non-metallic packer shoe having a multitude of co-acting segments and at least one retaining band, and preferably two non-metallic bands, for holding the shoe segments in place after initial assembly and during the running of the tool into the wellbore and prior to the setting of the associated packer element within the well bore. The preferred packer shoe assembly of the downhole tool disclosed herein further consists of packer shoe segments preferably being made of a phenolic or a composite material to withstand the stresses induced by relatively high differential pressures and high temperatures found within wellbore environments.

Additional objects and advantages of the invention will become apparent as the following detailed description of the preferred embodiments is read in conjunction with the drawings which illustrate the preferred embodiment of the present invention.

Figure 3A:
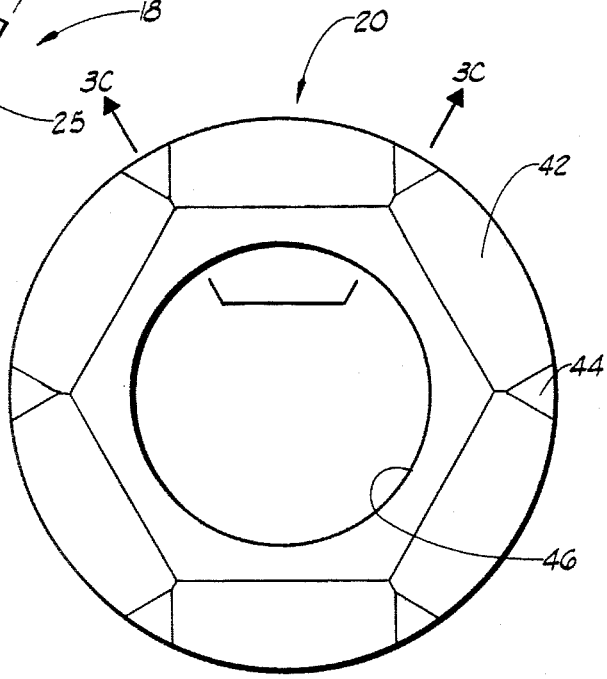
FIG. 3A PRIOR ART
FIG. 3A is top view of the preferred slip wedge shown in FIG. 1 and can be used with the present invention.

FIE. 3B is a cross-sectional side view of the preferred slip wedge shown in FIG. 3A.

Figure 3B:
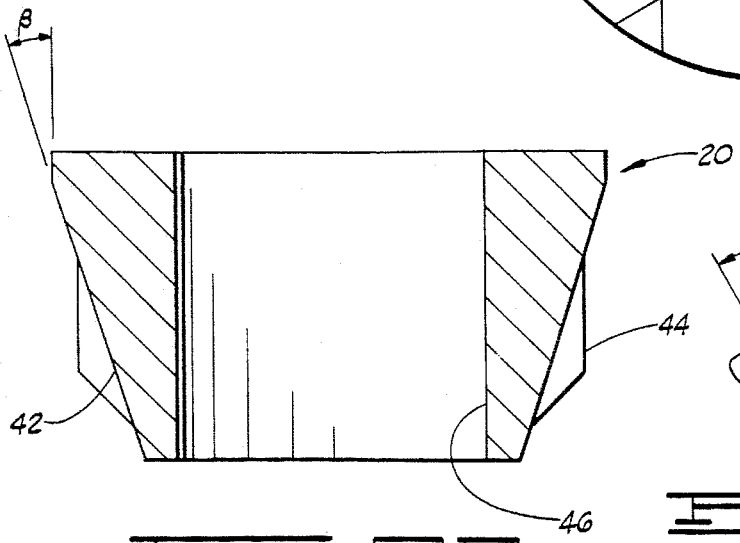
FIG. 3B PRIOR ART
Figure 3C:
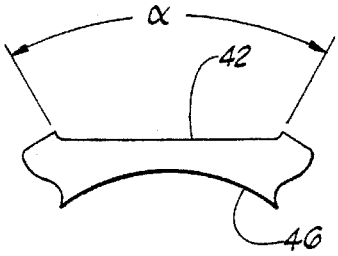
FIG. 3C PRIOR ART

FIG. 3C is an isolated sectional view of one of the multiple planar surfaces of the slip wedge taken along line 3C as shown in FIG. 3A.

Figure 4:
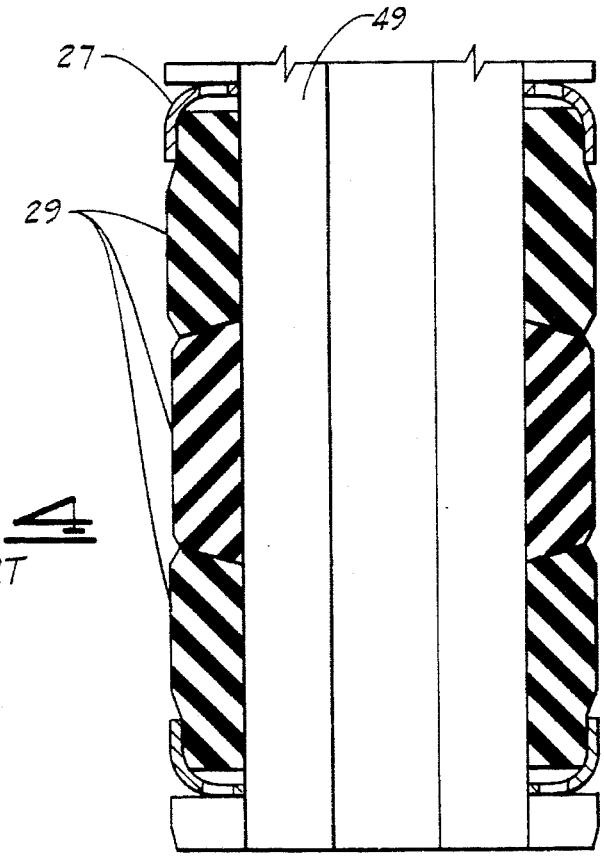
FIG. 4 PRIOR ART

FIG. 4 is a cross-sectional side view of an alternative prior art packer element retainer shoe.

Figure 5:
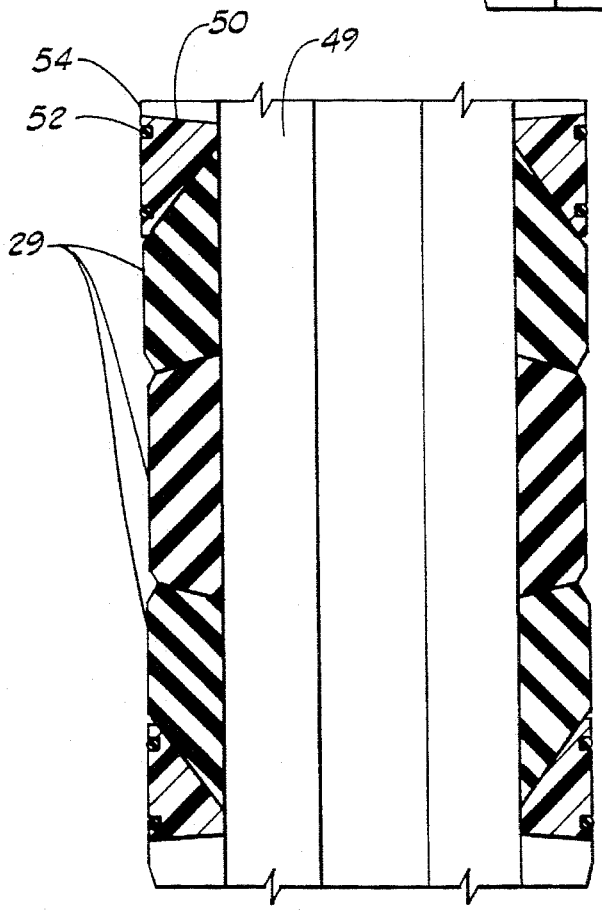
Figure 5A:
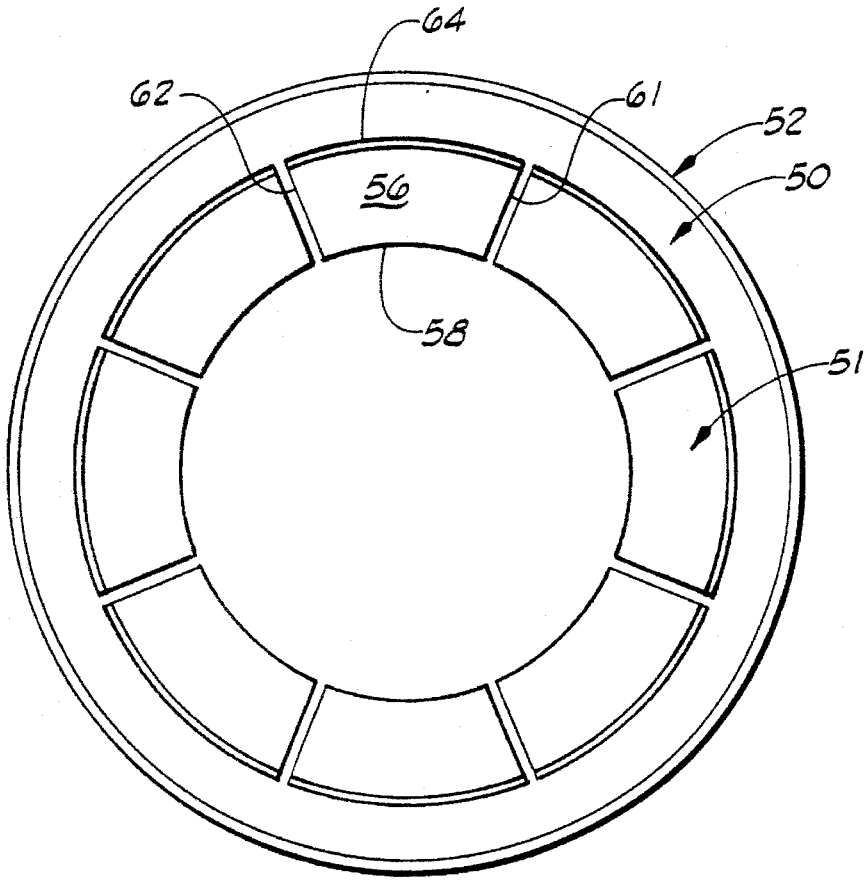
Figure 5B:
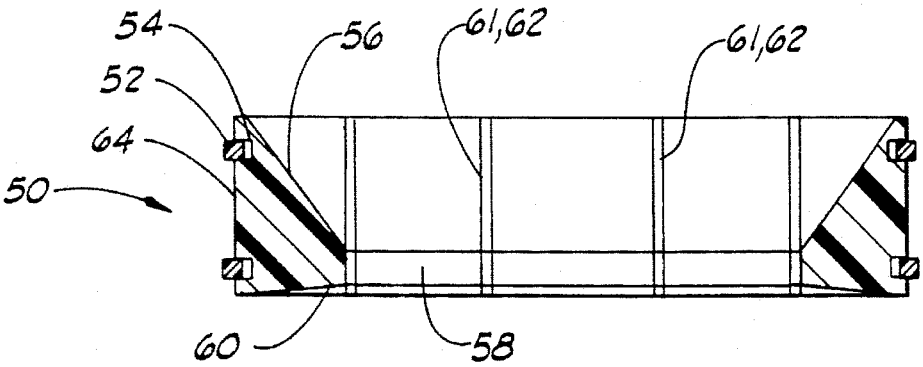

FIG. 5 is a cross-sectional side view of the preferred packer element retainer shoe of the present invention.

FIG. 6A is a top view of the preferred packer shoe and retaining band of the present invention. The retaining band is shown in an exageratedly expanded for clarity.

FIG. 6B is a cross-sectional side view of the packer element shoe shown in FIG. 6A.

DESCRIPTION OF THE PREFERRED EMBODIMENT

Referring now to the drawings. FIGS. 1–4 are all of prior art and have been provided for background and to show the preferred embodiment of a tool in which the present invention is particularly suitable for, but not limited to.

Figure 1:
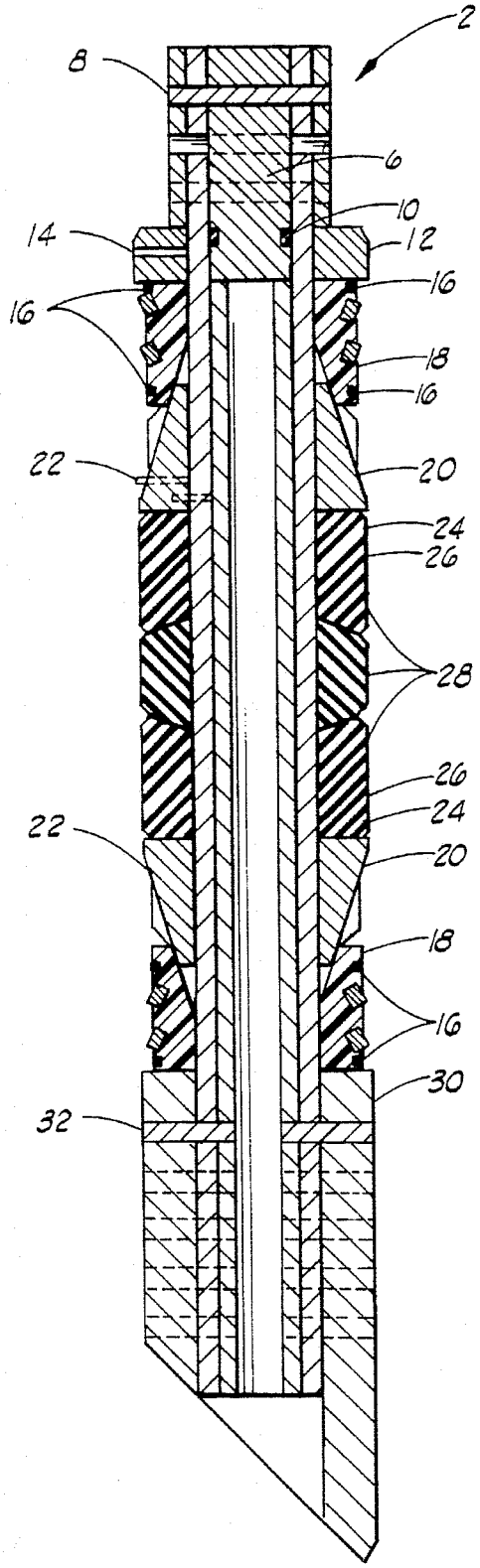
FIG. 1 PRIOR ART
FIG. 1 is a cross-sectional view of a prior art downhole packer apparatus depicting prior art packer shoe assemblies having the preferred slips and slip assemblies that can be used in connection with the present invention.

FIG. 1 is a prior art representation of a downhole tool 2 having a mandrel 4. The particular tool of FIG. 1 is referred to as a bridge plug due to the tool having a plug 6 being pinned within mandrel 4 by radially oriented pins 8. Plug 6 has a seal means 10 located between plug 6 and the internal diameter of mandrel 4 to prevent fluid flow therebetween. The overall tool structure, however, is quite adaptable to tools referred to as packers, which typically have at least one means for allowing fluid communication through the tool. Packers may therefore allow for the controlling of fluid passage through the tool by way of a one or more valve mechanisms which may be integral to the packer body or which may be externally attached to the packer body. Such valve mechanisms are not shown in the drawings of the present document. The representative tool may be deployed in wellbores having casings or other such annular structure or geometery in which the tool may be set.

Tool 2 includes the usage of a spacer ring 12 which is preferably secured to mandrel 4 by pins 14. Spacer ring 12 provides an abutment which serves to axially retain slip segments 18 which are positioned circumferentially about mandrel 4. Slip retaining bands 16 serve to radially retain slips 18 in an initial circumferential position about mandrel 4 as well as slip wedge 20. Bands 16 are made of a steel wire, a plastic material, or a composite material having the requisite characteristics of having sufficient strength to hold the slips in place prior to actually setting the tool and to be easily drillable when the tool is to be removed from the wellbore. Preferably bands 16 are inexpensive and easily installed about slip segments 18. Slip wedge 20 is initially positioned in a slidable relationship to, and partially underneath slip segments 18 as shown in FIG. 1. Slip wedge 20 is shown pinned into place by pins 22. The preferred designs of slip segments 18 and co-acting slip wedges 20 will be described in more detail herein.

Located below slip wedge 20 is at least one packer element, and as shown in FIG. 1, a packer element assembly 28 consisting of three expandable elements positioned about mandrel 4. At both ends of packer element assembly 28 are packer shoes 26 which provide axial support to respective ends of packer element assembly 28. Backup rings 24 which reside against respective upper and lower slip wedges 20 provide structural support to packer shoes 26 when the tool is set within a wellbore. The particular packer element arrangement show in FIG. 1 is merely representative as there are several packer element arrangements known and used within the art.

Located below lower slip wedge 20 are a plurality of multiple slip segments 18 having at least one retaining band 16 secured thereabout as described earlier.

At the lowermost terminating portion of tool 2 referenced as numeral 30 is an angled portion referred to as a mule-shoe which is secured to mandrel 4 by radially oriented pins 32. However lowermost portion 30 need not be a mule shoe but could be any type of section which serves to terminate the structure of the tool or serves to be a connector for connecting the tool with other tools, a valve, or tubing etc. It should be appreciated by those in the art, that pins 8, 14, 16, 22, and 32, if used at all, are preselected to have shear strengths that allow for the tool be set and to be deployed and to withstand the forces expected to be encountered in a wellbore during the operation of the tool.

As described in the patents referenced herein, the majority of the components in tool 2 of FIG. 1, with the exception of packer shoes 26 and back up rings 24, are made of a non-metallic material. Prior to the present invention, the use of metallic packer shoes and back up rings were required to be used in the Assignee's line of FAS DRILL downhole tool line because of the lack of a suitable non-metallic material being known or available that could withstand the pressures and temperatures typically encountered in a well-bore in which the tool was to be deployed. Additionally, a downhole tool having a packer element assembly 29 positioned about a mandrel 49 as shown in the broken away cross-sectional view of FIG. 4, it is known within the art that a metallic packer element back up shoe 27 not having a back up ring to provide additional support to the shoe can be used in certain circumstances. However, a single metallic shoe, such as shoe 27 of prior art FIG. 4, can nonetheless cause problems upon milling or drilling out the tool due to the drill and mill resistant nature of the metallic material of a prior art single shoe, especially when non-conventional milling or drilling techniques are being used.

Referring now to FIG. 5 of the drawings. A broken away cross-sectional view of a tool having a mandrel 49 which has a packer element assembly 29 positioned thereabout, shows a packer shoe 50 embodying the present invention. Improved packer shoe 50 is preferably made of a phenolic material available from General Plastics, 5727 Ledbetter, Houston, Tex., 77087-4095. Other suitable materials include a direction-specific laminate material referred to as GP3581 also available from General Plastics and structural phenolics available from commercial suppliers such as Fiberite, 501 West 3rd Street, Winona, Minn. 55987. Particularly well suited phenolic materials available from Fiberite include, but are not limited to, material designated as FM 4056J and FM 4005.

As can be seen in FIG. 5, each end most section of packer element 29 resides directly against shoe 50, which in the preferred embodiment does not employ a backup ring. Each shoe 50 preferably has circumferential grooves 54 about the external periphery of shoes 50 for accommodating retaining band 52. Retaining band 52 serves to secure shoes 50 adjacent each respective end of packer element 29 after the shoes have been initially installed, during transit, and during the running in of the tool into a well bore prior to deploying the tool.

Referring to FIG. 6A which is a view of the preferred non-metallic packer shoe 50 depicted in FIG. 5. FIG. 6B is a cross-sectional view of shoe 50. Packer shoe 50 preferably has a plurality of individual shoe segments 51 to form a shoe that encircles a mandrel or center section of a downhole tool having a packer element. Shoe segments 51 preferably include an internal surface 56 which is shaped to accommodate the endmost portion of a packer element thereagainst. Surface 56 is therefore preferably sloped as well as arcuate to provide generally a truncated conical surface which transitions from having a greater radius proximate to external surface 64 to a smaller radius at internal diameter 58. The ends of shoe segment 50 are defined by surfaces 61 and 62 which are flat and convergent with respect to a center reference point CL which, if the shoe segments were installed about a mandrel, would correspond to the axial centerline of that mandrel as depicted in FIGS. 4 and 5. End surfaces 61 and 62 need not be flat and could be of other topology.

FIG. 6A illustrates shoe 50 being made of a total of 8 shoe segments to provide a 360° annulus, or encircling, structure to provide the maximum amount of end support for a packer element that is to be retained in an axial direction. A lesser amount, or greater amount of shoes segments can be used depending on the nominal diameters of the mandrel, the packer elements, and the wellbore or casing in which the tool is to be deployed.

Shoe retaining band 52, which is shown as being exageratedly expanded and distant from outer external surfaces 64 of shoe 50. Shoe retaining band 52 is preferably made of a non-metallic material such as composite materials available from General Plastics, 5727 Ledbetter, Houston, Tex., 77087-4095. However, shoe retaining bands 52 may alternatively be of a metallic material such as ANSI 1018 steel or any other material having sufficient strength to support and retain the shoes in position prior to actually setting a tool employing such bands. Furthermore, retaining bands 50 may have either elastic or non-elastic qualities depending on how much radial, and to some extent axial, movement of the shoe segments can be tolerated prior to and during the deployment of the associated tool into a wellbore.

Shoe 50 as shown in FIG. 6B has two retaining bands 52 and respective band accommodating grooves 54. Grooves 54 are each located proximate to face 60 and proximate to upper most region where outer external surface 64 and arcuate surface 56 intersect, or the distance between the two is at minimum. As discussed earlier, a single band 52, appropriately sized and made of a preselected material, can be used. Alternatively, a multitude of bands appropriately sized and made of suitable material can be used in lieu of the preferred pair of retaining bands 52.

Tests have been performed using a downhole packer tool, similar to the representative bridge plug tool shown in FIG. 1, having the preferred packer shoe 50 wherein the shoe segments 51 were constructed in accordance with the above description and FIGS. 5–6 of the drawings. The test segments were made of a phenolic material obtained from General Plastics as referenced herein.

The test tool was installed in a test chamber and the tool was set and the tool and associated packer elements were then subjected to a maximum differential pressure of 8000 psi (562 Kg/cm$^2$) and a maximum temperature of 250° F. (120° C.). Upon inspection of the subject shoe segments after the test, the segments had flared outwardly to and were ultimately restrained by the well bore. The subject shoe segments successfully retained and supported the respective ends of the associated packer elements. Thus it is fully expected that pressures reaching 10,000 psi (700 Kg/cm$^2$) and temperatures reaching 400° (205° C.) are obtainable using shoes embodying the present invention. The subject test shoes were initially retained by a pair of retaining bands as described herein and made of a composite material obtained from General Plastics as referenced herein. The associated packer element ends were inspected after the test was performed and found to be in a satisfactory condition with only expected non-catastrophic deformation of the packer element assembly present.

Returning now to FIGS. 2–4 of the drawings. Although, it is admitted that slip segments 18 and slip wedges 20 are prior art, it is preferred that the subject slip segments and slip wedges be constructed as discussed below in order to take full advantage of features and benefits of downhole tools constructed essentially of only non-metallic components as discussed herein.

However, it is not necessary to have the particular slip segment and slip wedge construction shown in FIGS. 2–4 in order to practice the present invention, as the disclosed packer element shoes can be used in connection with any type of downhole tool employing at least one packer element whether or not the tool is made essentially of only non-metallic components or a combination of metallic and non-metallic components.

Figure 2A:
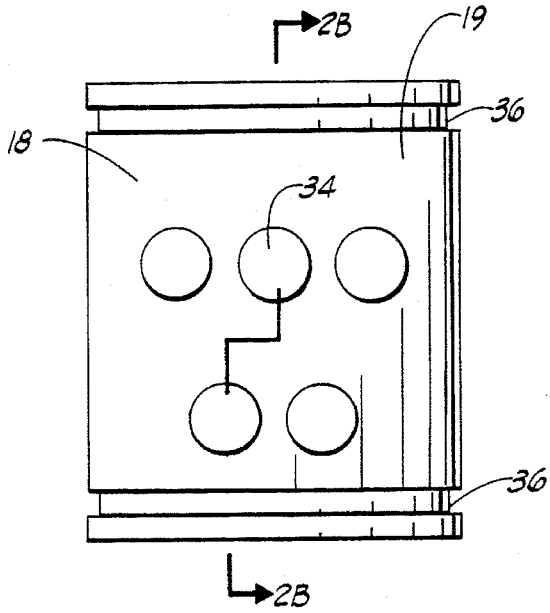
FIG. 2A PRIOR ART
FIG. 2A is a front view of the preferred slip shown in FIG. 1 that can be used with the present invention.

Preferably, slip segment 18 as shown in a front view of the slip segment, denoted as FIG. 2A, has an outer external face 19 in which at least one and preferably a plurality of inserts 34 have been molded into, or otherwise secured into, face 19. Inserts 34 made of zirconia ceramic have been found to be particularly suitable for a wide variety of applications. Slip segment 18 is preferably made of a composite material obtained from General Plastics as referenced herein in addition to the materials set forth in the present Assignee's patents referenced herein.

Figure 2B:
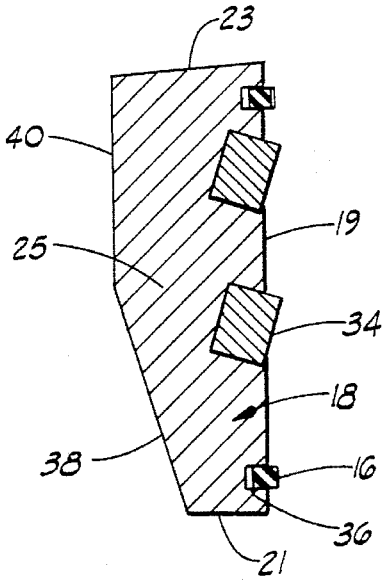
FIG. 2B PRIOR ART
FIG. 2B is a cross-sectional side view of the preferred slip segments shown in FIG. 2A.
Figure 2C:
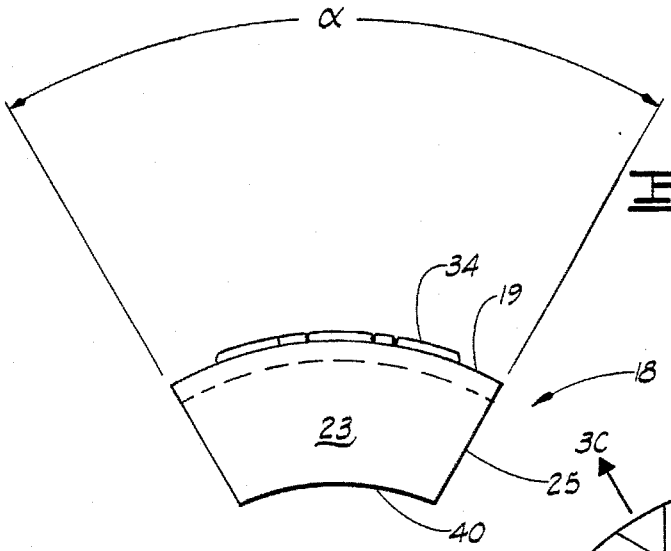
FIG. 2C PRIOR ART
FIG. 2C is a top view of the preferred slip segments shown in FIGS. 2A and 2B.

FIG. 2B is a cross-sectional view taken along line 2B of slip segment of 18 FIG. 2A. Slip segment 18 has two opposing end sections 21 and 23 and has an arcuate inner mandrel surface 40 having topology which is complementary to the outer most surface of mandrel 4. Preferably end section surface 23 is angled approximately 5°, shown in FIG. 2B as angle θ, to facilitate outward movement of the slip when setting the tool. Slip segment bearing surface 38 is flat, or planar, and is specifically designed to have topology matching a complementary surface on slip wedge 20. Such matching complementary bearing surface on slip wedge 20 is designated as numeral 42 and can be viewed in FIG. 3A of the drawings. A top view of slip segment 18, having a flat, but preferably angled, top surface 23 is shown in FIG. 2C. Location and the radial positioning of sides 25 define an angle α which is preselected to achieve an optimal number of segments for a mandrel having an outside diameter of a given size and for the casing or well bore diameter in which the tool is to be set. Angle α is preferably approximately equal to 60°. However, an angle of α ranging from 45° to 60° can be used.

Returning to FIG. 2B, the sides of slip segments 18 are designated by numeral 25. It is preferred that six to eight segments encircle mandrel 4 and be retained in place prior to setting of the tool by at least one, and preferably two slip retaining bands 16 that are accommodated by circumferential grooves 36. Slip retaining bands 16 are made of composite material obtained from General Plastics as referenced herein or other suitable materials such as ANSI 1018 steel wire available from a wide variety of commercial sources.

Referring to FIG. 3A, a top view is provided of preferred slip wedge 20 having flat, or planar, surfaces 42 which form an opposing sliding bearing surface to flat bearing surface 38 of respectively positioned slip segments 18. The relationship of such surfaces 38 and 42 as installed initially are best seen in FIG. 2B, FIG. 3C, and FIG. 1. As can be seen in FIG. 3C, which is a broken away sectional view taken along line 3C shown in FIG. 3A. It is preferred that slip wedge bearing surface 42 be defined by guides or barriers 44 to provide a circumferential restraint to slip segments 18 as the segments travel axially along slip wedge 20 and thus radially outwardly toward the casing or well bore during the actual setting of the packer tool. Preferably angle β, as shown in FIG. 3B is approximately 18°. However, other angles ranging from 15° to 20° can be used depending on the frictional resistance between the coacting surfaces 42 and 38 and the forces to be encountered by the slip and slip wedge when set in a well bore. Internal bore 46 is sized and configured to allow positioning and movement along the outer surface of mandrel 4.

It has been found that material such as the composites available from General Plastics are particularly suitable for making a slip wedge 20 from in order to achieve the desired results of providing an easily drillable slip assembly while being able to withstand temperatures and pressures reaching 10,000 psi (700 Kg/cm$^2$) and 425° F. (220° C.). Additionally, suitable material includes the materials set forth herein and in the present Assignee's patents referenced herein.

A significant advantage of using such co-acting flat or planar bearing surfaces in slip segments 18 and slip wedges 20 is that as the slips and wedges slide against each other, the area of contact is maximized, or optimized, as the slip segments axially traverse the slip wedge thereby minimizing the amount of load induced stresses being experienced in the contact area of the slip/slip wedge interface. That is as the slip axially travels along the slip wedge, there is more and more contact surface area available in which to absorb the transmitted loads. This feature reduces or eliminates the possibility of the slips and wedges binding with each other before the slips have ultimately seated against the casing or wellbore. This arrangement is quite different from slips and slip cones using conical surfaces because when using conical bearing surfaces, the contact area is maximized only at one particular slip to slip-cone position.

The practical operation of downhole tools embodying the present invention, including the representative tool depicted and described herein, is conventional and thus known in the art as evidenced by prior documents.

Furthermore, although the disclosed invention has been shown and described in detail with respect to the preferred embodiment, it will be understood by those skilled in the art that various changes in the form and detail thereof may be made without departing from the spirit and scope of this invention as claimed.

What is claimed is:

1. A downhole apparatus for use in a wellbore comprising:

a) a mandrel having an axial centerline;

b) a slip means disposed on the mandrel for grippingly engaging the wellbore when set into position;

c) at least one packer element to be axially retained about the mandrel and located at a preselected position along the mandrel defining a packer element assembly; and d) at least one packer element retaining shoe made of a non-metallic material for axially retaining the at least one packer element about the mandrel and the shoe comprising a plurality of shoe segments and having means for retaining the segments in an initial position about the mandrel.

2. The apparatus of claim 1 wherein at least a portion of the retaining shoe is made of a phenolic material.

3. The apparatus of claim 1 wherein at least one of the shoe segments is made of a phenolic material.

4. The apparatus of claim 1 wherein at least one of the shoe segments is made of a laminated non-metallic composite material.

5. The apparatus of claim 1 wherein the shoe retaining means comprises at least one retaining band made of a non-metallic composite material.

6. The apparatus of claim 1 wherein the shoe segment has an external face having at least one groove therein to accommodate at least one retaining band.

7. The apparatus of claim 1 wherein the mandrel, and at least a portion of the slip means, is made of a non-metallic material.

8. The apparatus of claim 1 wherein the mandrel is made of a non-metallic composite and the slip means is made at least partially of a non-metallic composite.

9. The apparatus of claim 1 wherein the slip means comprises: a plurality of slip segments and an associated slip wedge being located proximate to an end most portion of a packer element assembly, each of the slip segments having a planar bearing surface and the associated slip wedge having a corresponding planar bearing surface for the planar bearing surface of each slip segment.

10. The apparatus of claim 9 wherein the planar bearing surfaces of the slip segments and the slip wedge are inclined at an angle between 15° and 20° with respect to the axial centerline of the mandrel.

11. The apparatus of claim 10 wherein the angle of inclinations of the planar bearing surfaces are approximately 18°.

12. A downhole apparatus for use in a well bore comprising:

a) a mandrel made of a non-metallic material and having an axial centerline;

b) a spacer ring made of a non-metallic material being secured to the mandrel;

c) a first plurality of upper slip segments proximate to the spacer ring and encircling a portion of the mandrel, the upper slip segments being restrained in an initial position by a retaining means, the upper slip segments being made of a non-metallic material forming an upper slip means for grippingly engaging the wellbore when set into position, each slip segment having a planar bearing surface;

d) a non-metallic upper slip wedge encircling and slidable along a portion of the mandrel, the slip wedge located adjacent to the upper slip segments, the upper slip wedge further having a plurality of planar bearing surfaces inclined with respect to the axial centerline of the mandrel being complementary to and for coacting with the planar bearing surfaces of respective slip segments;

e) a first plurality of non-metallic packer element retaining shoe segments encircling a portion of the mandrel and being positioned and restrained by a retaining means so as to be proximate to the upper slip wedge, the shoe segments having an internal surface configured to accommodate an end portion of a packer element assembly;

f) a packer element assembly comprising at least one packer element having a first end portion proximate to and accommodatable by the internal surface of the first shoe segments, the packer assembly generally encircling a portion of the mandrel;

g) a second plurality of non-metallic packer element retaining shoe segments being positioned and restrained by a retaining means so as to be proximate to an opposite end of the packer assembly and encircling a portion of the mandrel, the second plurality of shoe elements having an internal surface configured to accommodate the opposite end of the packer element assembly;

h) a lower non-metallic slip wedge encircling and slidable along a portion of the mandrel, the lower slip wedge located adjacent to a second plurality of lower slip segments, the lower slip wedge further having a plurality of planar bearing surfaces inclined with respect to the axial centerline of the mandrel being complementary to and for coacting with the planar bearing surfaces of respective slip segments;

i) a second plurality of slip segments proximate to a second end portion of at least one packer element and encircling a portion of the mandrel, the second plurality of slip segments made of a non-metallic material and being initially restrained by a retaining means to form a lower slip means for grippingly engaging the wellbore when set into position, each lower slip segment having a planar bearing surface; and j) an end most terminating portion to the downhole tool, the terminating portion being proximate to the lower slip segments and being secured to the mandrel.

13. The apparatus of claim 12 wherein at least one of the components set forth therein is made of phenolic, laminated composite, or engineering grade plastic.

14. The apparatus of claim 12 wherein at least one of the components is secured to the mandrel by pins.

15. The apparatus of claim 12 wherein at least one of the slip segment retaining means or the shoe segment retaining means comprises at least one retaining band made of composite, phenolic, or engineering grade plastic.

16. The apparatus of claim 15 wherein there is a groove in the slip segment or shoe segment for accommodating at least one retaining band therein.

17. The apparatus of claim 12 wherein at least one slip segment has at least one hardened insert made of zirconia ceramic.

18. The apparatus of claim 12 wherein in the angles of inclination of the bearing surfaces are in the range of 15 to 19 degrees.

19. The apparatus of claim 13 wherein the slip wedges have guide means for axially guiding and the slip segments as the slip segments and the slip wedge sliding engage with each other during the setting of the tool.

* * * * *